US005246071A

United States Patent [19]

Chu

[11] Patent Number: 5,246,071

[45] Date of Patent: Sep. 21, 1993

[54] STEAMFLOODING WITH ALTERNATING INJECTION AND PRODUCTION CYCLES

[75] Inventor: Chieh Chu, Houston, Tex.

[73] Assignee: Texaco Inc., White Plains, N.Y.

[21] Appl. No.: 830,161

[22] Filed: Jan. 31, 1992

[51] Int. Cl.[5] ..... E21B 43/24; E21B 43/30

[52] U.S. Cl. ..... 166/245; 166/263; 166/272

[58] Field of Search ..... 166/245, 263, 272

[56] References Cited

U.S. PATENT DOCUMENTS 3,332,480 7/1967 Parrish ..... 166/245
3,845,817 11/1974 Hoyt et al. ..... 166/263 X
4,166,501 9/1979 Korstad et al. ..... 166/245 X
4,182,416 1/1980 Trantham et al. ..... 166/263 X
4,324,291 4/1982 Wong et al. ..... 166/263 X
4,610,301 9/1986 Ghassemi et al. ..... 166/245
4,641,709 2/1987 Powers et al. ..... 166/245 X

*Primary Examiner*—George A. Suchfield
*Attorney, Agent, or Firm*—James L. Bailey; Jack H. Park; Harold J. Delhommer

[57] ABSTRACT

A method of staggered scheduling of injection and/or production into and from alternate rows of injection and/or production wells in hydrocarbon formations penetrated by multiple 5-spot, inverted 5-spot, 7-spot or 9-spot well patterns.

15 Claims, 6 Drawing Sheets

STAGE I

STAGE II

STEAMFLOODING WITH ALTERNATING INJECTION AND PRODUCTION CYCLES

BACKGROUND OF THE INVENTION

This invention relates to a method to improve the recovery of steamflooding. More particularly, the method comprises injection of steam or production of hydrocarbons by injection or production through alternating rows of wells.

Numerous techniques have been suggested to enhance the recovery of hydrocarbons from underground formations. Waterflooding and steamflooding have proven to be the most successful of these recovery techniques employed commercially. However, these techniques may still leave up to 60% to 70% of the original hydrocarbons in place, depending on the characteristics of the formation and the oil.

In conventional steamflooding, steam is injected into the formation and fluids are produced from the formation until the ratio of hydrocarbons produced to steam injected is so low as to make the flood no longer economical. In a typical steamflood, after steam breaks through to the producing wells, the proportion of hydrocarbons produced relative to injected steam steadily decreases. Steam breakthrough at the production well generally indicates that a flowpath of steam from the injection wells to the production wells has formed. Once formed, such a flowpath will generally be followed by later injected steam, thereby diminishing the ability of the later injected steam to reach and displace hydrocarbons in portions of the formation not adjacent to the flowpath.

Various methods have been proposed to overcome the disadvantages of such steam channelling and override in a steamflood. These methods include surfactants, steam foams, gels, additional wells, fracturing, and other techniques. U.S. Pat. No. 3,385,360 discloses a cyclic steam drive wherein the rate of steam injection is reduced in the low cycle to no more than 60% of the initial injection. The patent also states that the quality and temperature of the steam may be varied, although there is no disclosure of interruption of steam injection, or injection or production in alternating rows.

U.S. Pat. No. 3,480,081 discloses pressure pulsing of oil production, wherein one embodiment describes the injection of steam during a pressurizing step while other wells are produced during a depressurizing step. U.S. Pat. No. 3,273,640 describes a complicated process for the extraction of shale oil from rock involving pressurization with steam and an intermittent relief of the pressure to encourage flow from voids and edges of the shale formation.

Pressurization and production interruptions are disclosed in numerous tar sand and bitumen references. But because of the different structure of tar sands and bitumen, these processes encourage channelling, the exact opposite goal of the instant invention. Thus, such references to tar sand shale oil processes are not relevant to the present invention. One of these, J. A. Dilabough, et al., "Recovering Bitumen From Peace River Deposits," Oil & Gas Journal, Nov. 11, 1974, pp. 186–198 discloses a cyclic process for bitumen with repeated depressurizing steps starting from six months after injection of various fluids including steam and lasting for up to 1½ years.

U.S. Pat. Nos. 3,354,954 and 4,733,726 disclose the interrupted operation of a production well in steamflooding. T.M. Doscher, et al., "The Anticipated Effect of Diurnal Injection on Steamdrive Efficiency," Journal of Petroleum Technology, Aug. 1982, pp. 1814–1816 discusses a study of the performance of steam drives when cyclic steam injection is employed.

A variation on the WAG process called water-alternating-steam process (WASP) is disclosed in Hong, K.C. et al., "Water-Alternating-Steam Process Improves Project Economics at West Coalinga Field," CIM/SPE Paper No. 90-84, presented at the International Technical Meeting Hosted by the Petroleum Society of CIM and the SPE in Calgary, Alberta, Jun. 10–13, 1990. In this process steam injection is alternated with water injection.

A discussion on various oscillating injection and production methods for steamflooding can be found in a paper authored by the instant inventor. Please see, Chu, C., "Oscillating Injection-Production Schemes for Steamflooding Oil Reservoirs," SPE Paper No. 21797, presented at the Western Regional Meeting of the SPE in Long Beach, California, Mar. 20–22, 1991. The paper contains no discussion of staggered scheduling of injection or production into alternate rows of wells.

Other methods involving interrupted injection of steam with or without other fluids, and interrupted production of fluids, many for tar sands and bitumen or with the use of infill wells, are disclosed in a number of references. Some of these references are U.S. Pat. Nos. 4,088,188; 4,124,071; 4,160,481; 4,166,501; 4,166,502; 4,166,503; 4,166,504; 4,175,618; 4,177,752; 4,296,969; 4,431,056; 4,450,911; 4,465,137; 4,488,600; 4,491,180; 4,495,994; 4,515,215; 4,597,443; 4,612,990; and 4,700,779.

There continues to be a need for improving steamflood recoveries without significantly increasing the cost of the steamflood and without damaging the formation.

SUMMARY OF THE INVENTION

The invention is a method for recovering hydrocarbons from a hydrocarbon formation penetrated by multiple 5-spot, inverted 5-spot, 7-spot or 9-spot patterns of injection and production wells. The method comprises injecting steam into the formation through a first group of wells comprising approximately one-half of the injection wells of multiple patterns penetrating a formation or a portion of a formation. After a predetermined period of time, steam injection is ceased through the first group of wells and begun through a second group of wells comprising approximately the remaining one-half of the injection wells excluded from the first group.

After a predetermined period of time, steam injection is ceased through the second group of wells and steam injection is begun through a third group of wells comprising approximately one-half of the injection wells of the patterns. Later steam injection is ceased through the third group of wells and begun through a fourth group of wells comprising approximately the remaining one-half of the injection wells excluded from the third group.

The first group of injection wells comprises alternating rows of wells separated by alternating rows of the second group of injection wells. The third group of injection wells comprises alternating rows of wells separated by alternating rows of the fourth group of injection wells. It is possible for the first and third groups of injection wells to be the same, and for the second and fourth group of injection wells to be the same. Injection steps may be repeated or injection begun into analogous fifth and sixth groups of wells. The alternating rows of injection wells are arranged in horizontal rows, vertical rows or diagonal rows.

Hydrocarbons and other fluids are produced from production wells in the 5-spot, inverted 5-spot, 7-spot, or 9-spot well patterns in an alternate embodiment. Injection proceeds in a cyclic fashion through alternating rows of injection wells as described above and production occurs through alternating rows of production wells at different production rates, one production rate which is preferably a zero production rate. In another alternate embodiment, injection is continuous through the injection wells while production occurs through alternating rows of production wells at two different rates of production.

DETAILED DESCRIPTION

Figure 1:
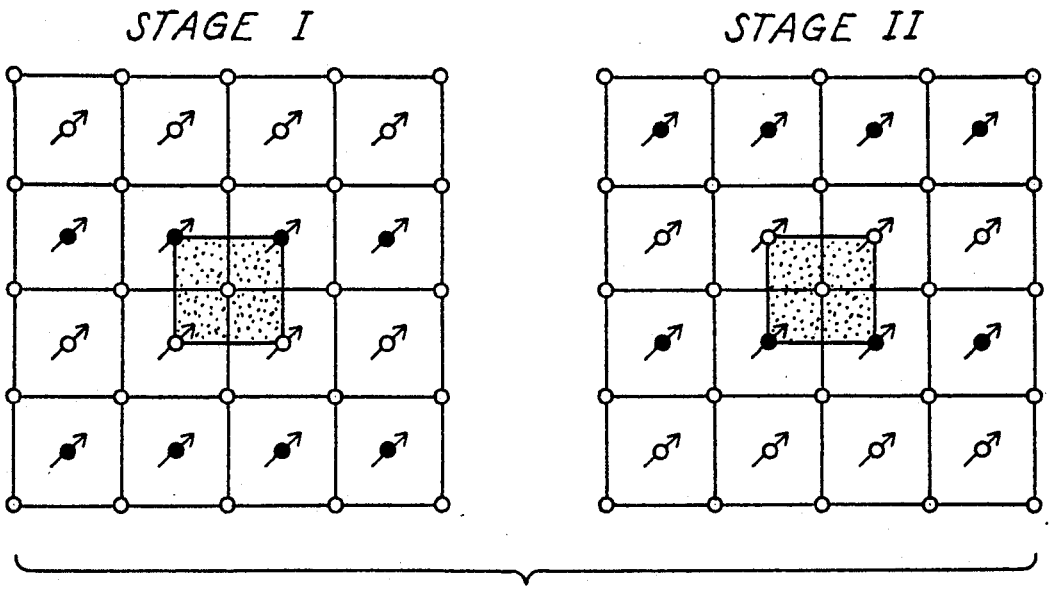
FIG. 1 is a diagram of staggered injection applied to alternating horizontal rows of injection wells of 5-spot patterns illustrating Example 5.
Figure 2:
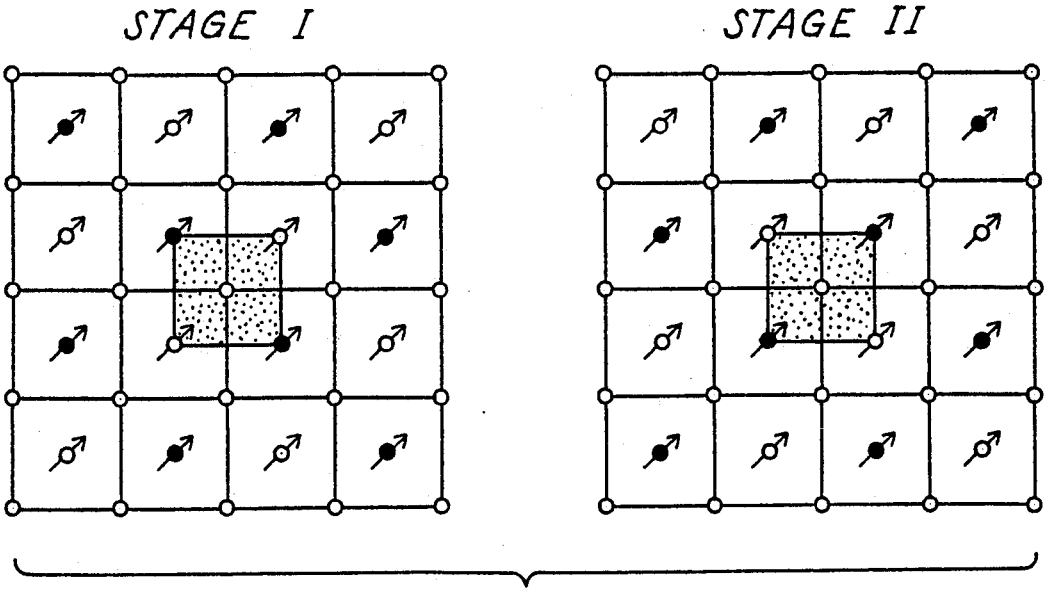
FIG. 2 is a diagram of staggered injection applied to alternating diagonal rows of injection wells of 5-spot patterns illustrating Example 6.
Figure 3:
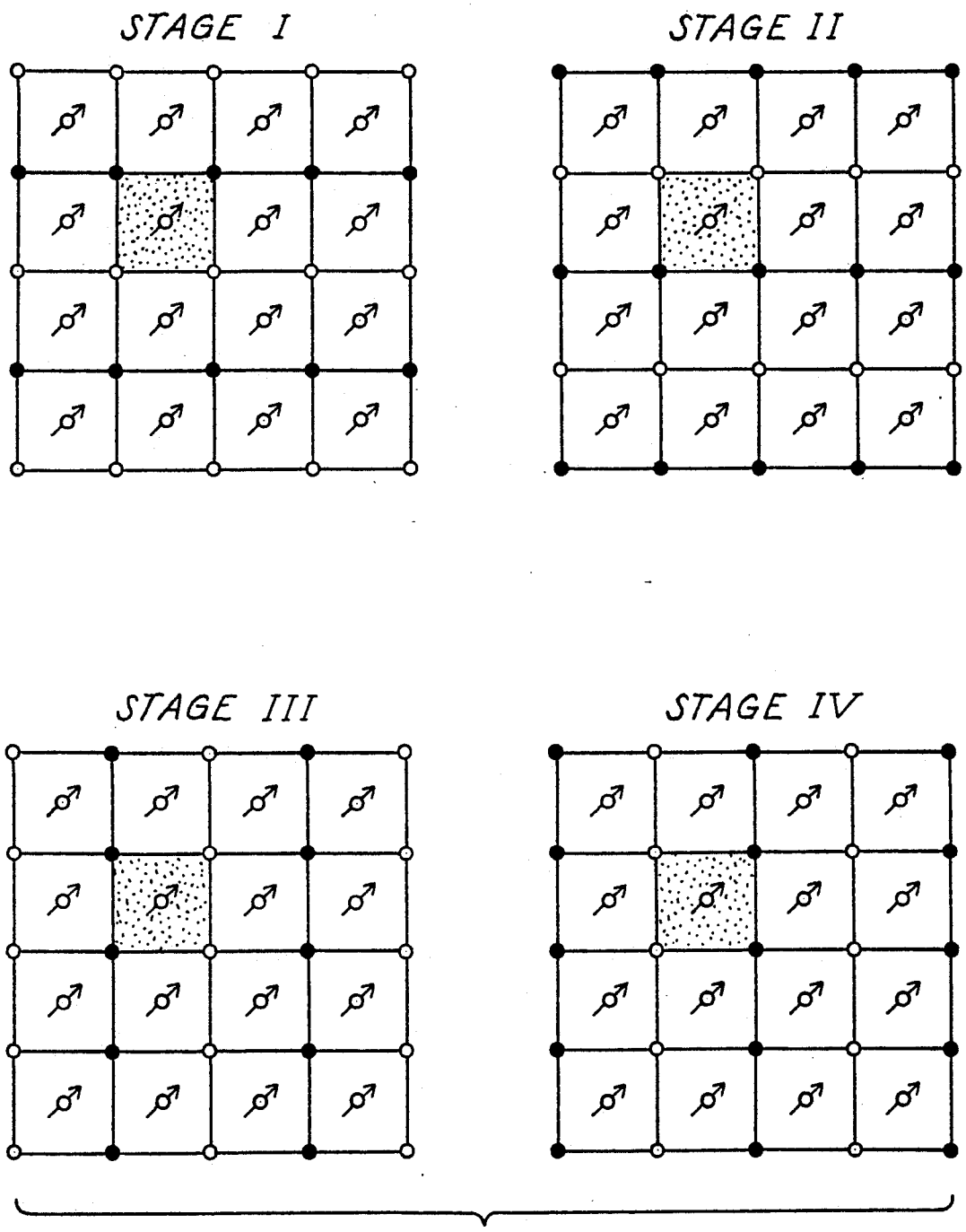
FIG. 3 is a diagram of staggered production applied first to alternating horizontal rows and then to alternating vertical rows of production wells of 5-spot patterns illustrating Example 7.
Figure 4:
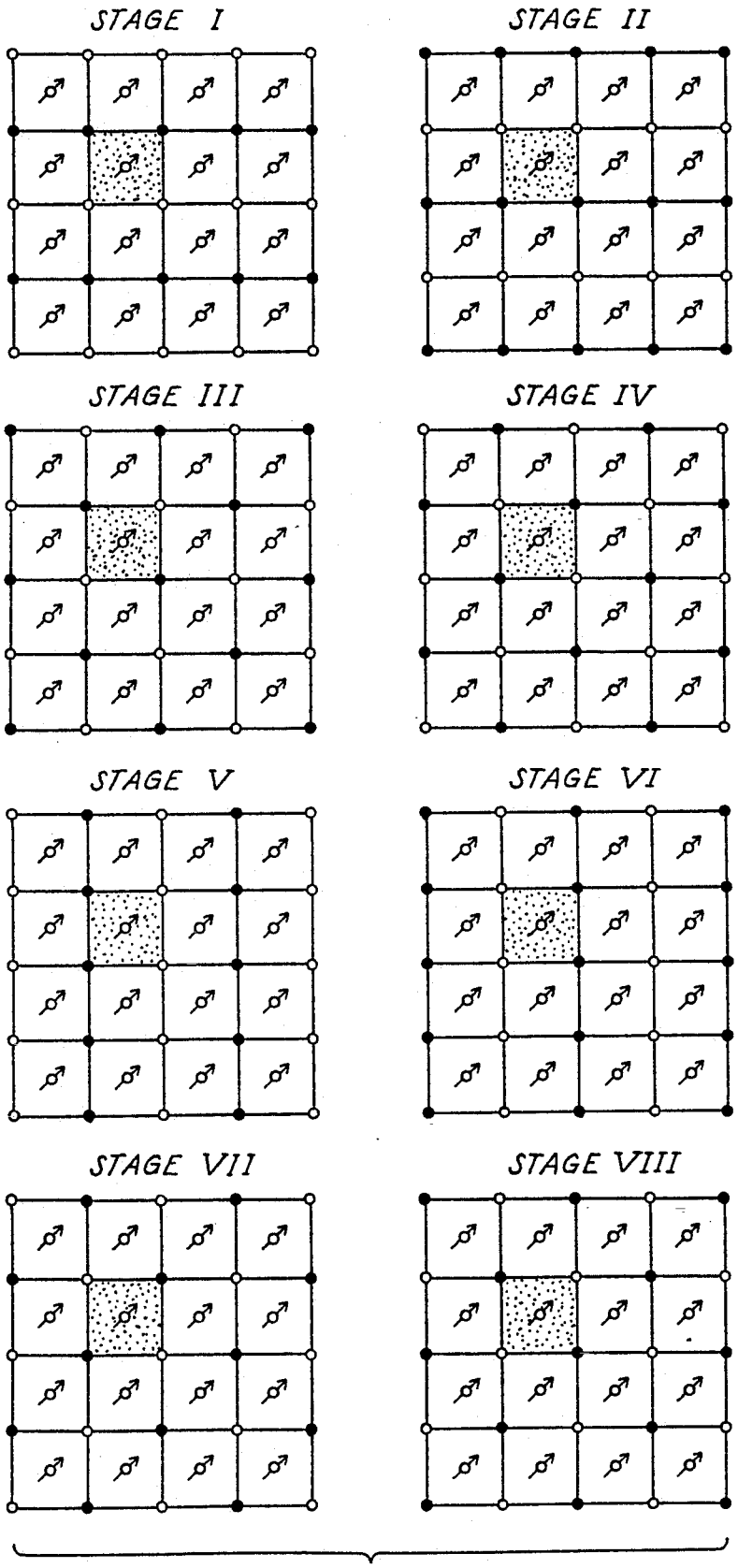
FIG. 4 is a diagram of staggered production applied first to alternating horizontal rows, then alternating diagonal rows, followed by alternating vertical rows, and concluding with alternating diagonal rows of production wells of 5-spot patterns illustrating Example 8.
Figure 5:
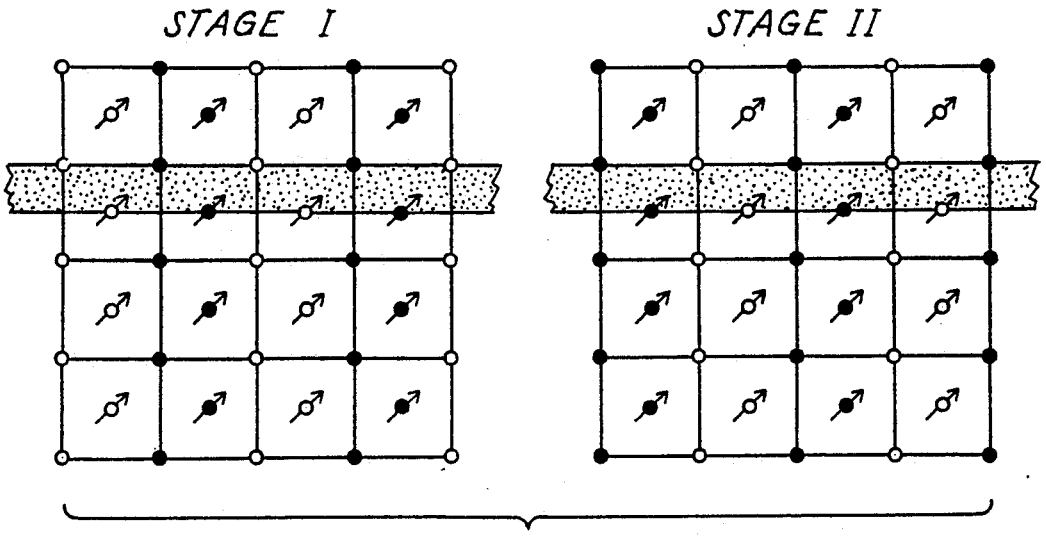
FIG. 5 is a diagram of staggered injection and production applied to alternating vertical rows of injection and production wells in 5-spot patterns illustrating Example 10.

The present invention provides a method of reducing steam channelling and override in steamfloods with the result of recovering oil more efficiently than with conventional steamflood methods. This method is particularly suited for recovering oil from subterranean formations wherein the oil has a viscosity less than about 25,000 centipoise (cps), and preferably is viscous "oil," with a viscosity less than about 15,000 cps. The method of this invention, while particularly suited for viscous oil, is not, however, preferred for or even applicable to tar sands or bitumen wherein the hydrocarbon usually has a viscosity greater than about 25,000 cps.

Although a number of prior art methods do not distinguish viscous oil from tar sands, the distinction for purposes of this invention is necessary. The present invention employs alternating steam injection and fluid production schemes. The alternating schemes are preferably conducted so that the reservoir fluids have periods of relaxation and equilibration with lessened chances of forming flow patterns or steam override. Flow patterns, if formed, are disturbed.

This invention is not applicable to tar sands or bitumen. In these formations, the viscosity of the hydrocarbons is so great that steam injection into the sands is itself difficult, as is fluid flow inside the sands. The goal and effect of cycles of steam pressurization, soaking and subsequent blowdown practiced with tar sands is the creation of channels for fluid flow, precisely the opposite goal of this invention and the problem this invention seeks to minimize.

This invention advocates the staggered scheduling of injection and/or production among alternating rows of injection and production wells in a hydrocarbon formation penetrated by multiple well patterns. Simply speaking, when one row of injection wells selected from multiple patterns is receiving steam injection, the immediately adjacent row of injection wells is not receiving steam injection. Then after a predetermined period of time, injection is ceased through the injection wells previously receiving injection and steam injection is begun through a second group of wells that did not receiving steam injection in the previous cycle.

The invention also includes practicing a similar procedure for the production wells with o without the staggered injection of steam into alternating rows of injection wells. With the steam injection in two alternating rows of injection wells, hydrocarbons and other fluids are produced by alternating between two different production rates for a first group of production wells and a second group of production wells, said first and second groups of production wells comprising alternating rows of wells. One of the two different production rates is a zero production rate or a very low production rate relative to the normal production rate. In the continuous injection embodiment, the invention requires that production be varied between alternating rows of production wells wherein one series of alternating rows of production wells is produced at normal rates, and adjacent rows of production wells are shut in and not produced.

The staggered scheduling of steam injection and/or staggered scheduling of production of the present invention doe not require that injection completely cease, or production completely cease in the off portion of the staggered cycling. For example, claim language which states that injection cease through a first group of wells and start through a second group of injection wells does not require complete cessation of injection. It is intended that such language include methods involving some injection and production during the off portions of the cycle as long as such injection or production is not significant, allowing the invention method to accomplish its purpose of disturbing the fluid distribution inside the reservoir and inhibit channelling.

Although various injection and production interruption schemes have been disclosed in steamflooding publications, the technology advance so far deals with a uniform scheduling of steam injection or fluid production for the entire project. The existing art only refers to interrupted injection and production at a single well or a consistent scheme of injection and production at all the wells. The existing technology does not disclose the invention idea of alternating or oscillating steam injection into alternating rows of injection wells and alternating or oscillating production from alternating rows of production wells.

The current technology of oscillatory injection an production in steamflooding has its inherent drawbacks. First, if injection follows an on and off cycle for the entire reservoir, the capacity of the steam generation facility must be increased to as much as twice the generation capacity needed for the instant invention. And yet, this large steam generation capacity will lie idle for part of the time. Second, if production is cycled at all the wells between on and off modes as disclosed in the existing technology, there is no revenue during the period when production is turned off, while expenses for steam generation continue to mount. For these reasons, most of the current oscillatory injection/production steam technologies are not economical.

To combat these drawbacks, the invention steamflooding method was devised. Computer simulation work indicates that the invention method provides different hydrocarbon recovery rates than the current technology of all wells on and off, and in some cases provides greater oil recovery than all wells on and off. And in almost all cases, the invention is more economical than current oscillation technology with its need for greater steam generation capacity and periods of zero production.

Simulation results compared with a base case of no oscillation (continuous injection and production) show that oil production is increased by an average of 2–3% with the staggered scheduling of injection wells alone, 3–8% with the staggered scheduling of production wells alone, and 5–7% with a staggered scheduling of both injection and production wells.

It is anticipated that the staggered scheduling of injection and/or production required by the invention method will disturb the fluid distribution inside the reservoir, improve sweep efficiency both aerially and vertically, and achieve higher oil recoveries. This is because the fluids inside the oil reservoir in certain locations will have alternating periods of relaxation and equilibration. Reservoir fluids will be forced to travel in different directions, inhibiting the chance of reservoir fluids forming distinct flow patterns. Once formed, flow patterns will be more evenly distributed through the reservoir. During the period when a production well is shut-in, a portion of the reservoir will be pressurized to some extent. Higher pressure means higher temperature in the presence of high quality steam and results in a reduction of oil viscosity and improved flow.

As can be seen in FIGS. 1-5, multiple 5-spot patterns offer several possibilities for alternating rows of injection or production wells. The rows of wells may be arranged in horizontal, vertical or diagonal directions of approximately 45° or 135° from the rows of injections wells. Recovery rates from using alternating horizontal rows should be the same as those rates which result from using alternating vertical rows. The same is true with alternating diagonal rows of approximately 45° and 135° . However, the use of alternating horizontal rows of wells followed by a change to alternating vertical rows of wells will yield different results due to a greater disturbance of fluid flow patterns and channelling within the reservoir.

As can be seen in FIGS. 6–9 where 7-spot patterns are involved, the alternating rows of injection and/or production wells may be arranged in a horizontal direction, a vertical direction, diagonal directions of approximately 30° , 60° , 120° , and 150° , from a horizontal line which bisects the patterns of FIGS. 6–9, or a mixture of the above. The same reasoning of similarly and different results noted above in the discussion on 5-spot well patterns applies here to 7-spot well patterns.

Figure 10:
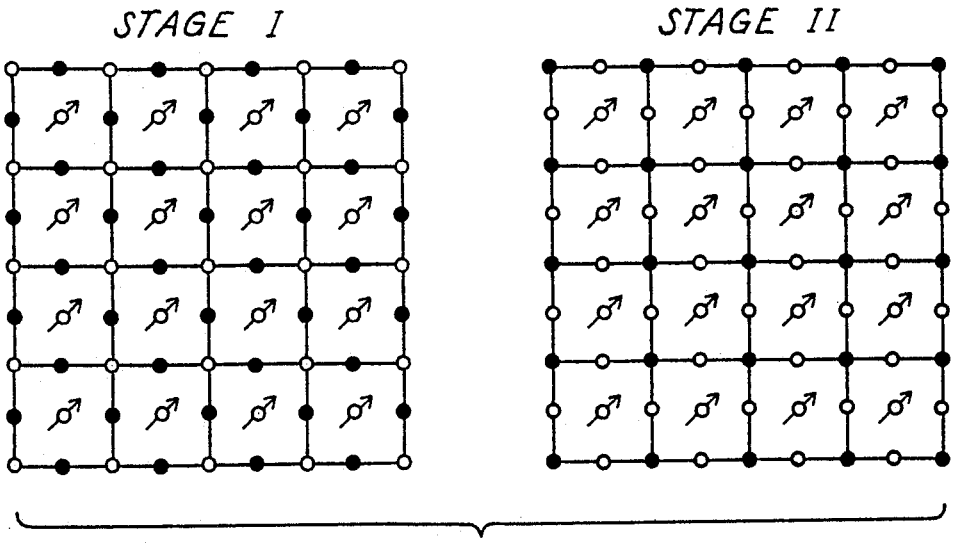
FIG. 10 is a diagram of staggered production applied to alternating diagonal rows of production wells in 9-spot patterns illustrating Example 20.
Figure 6:
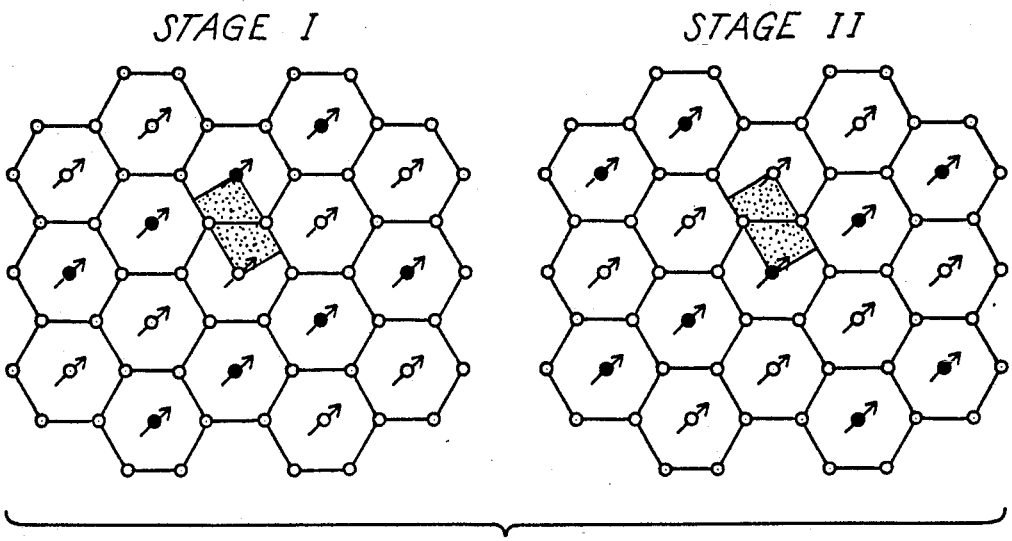
FIG. 6 is a diagram of staggered injection applied to alternating 120° rows of injection wells in 7-spot patterns illustrating Example 12.
Figure 7:
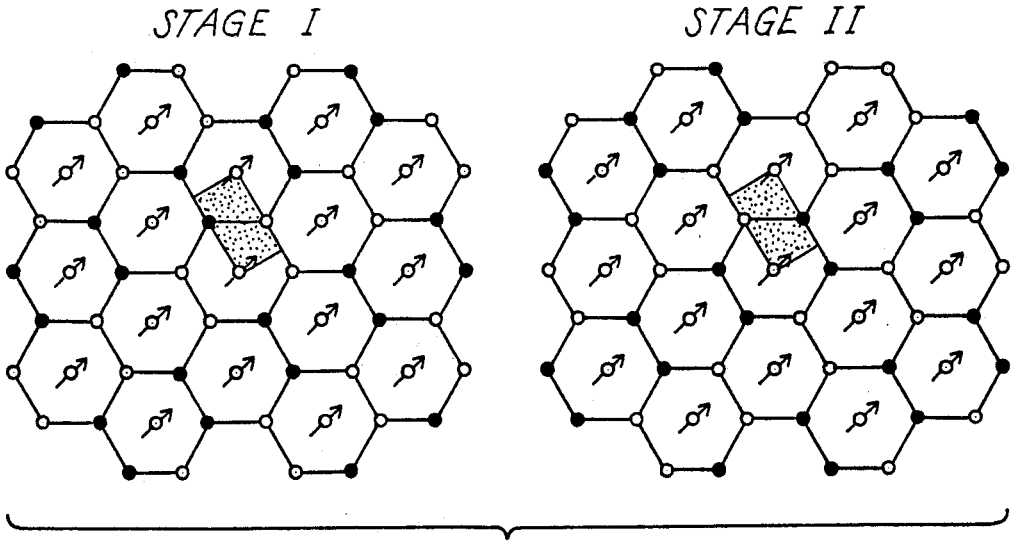
FIG. 7 is a diagram of staggered production applied to alternating 120° rows of production wells in 7-spot patterns illustrating Example 13.
Figure 8:
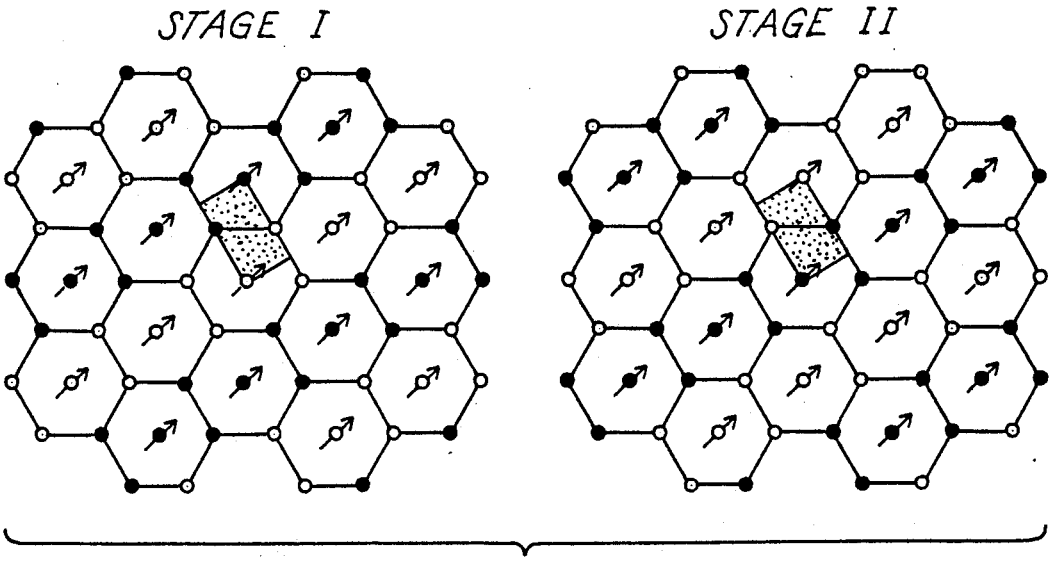
FIG. 8 is a diagram of staggered injection and production applied to alternating 30° rows of injection and production wells in 7-spot patterns illustrating Example 14.
Figure 9:
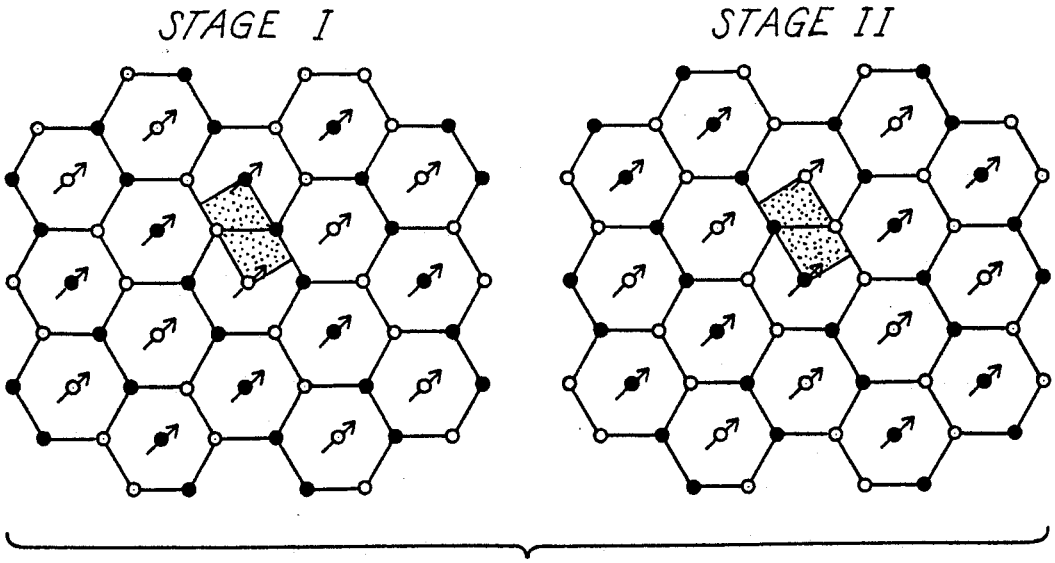
FIG. 9 is a diagram of staggered injection and production applied to alternating 120° rows of injection and production wells in 7-spot patterns illustrating Example 15.

Invention embodiments involving 9-spot well patterns (FIG. 10) are very similar to the cases involving 5-spot well patterns. Except for customary well spacing differences which do affect fluid flow in the formation, a 9-spot is the same as a 5-spot with the addition of four side wells.

To accomplish the purposes of this invention, it is important that the injection or production oscillations extend through at least four periods (or stages) or two cycles of on and off. Preferably, the invention will be practiced through more periods than four, and will be practiced for the entire life of production from the reservoir after primary recovery. Although this invention is best employed for viscous oil reservoirs where it is unlikely that significant amounts of oil will be produced by primary production, invention benefits may also be realized by the invention after another enhanced recovery technique has been employed. And benefits of the invention may also be realized even though application is discontinued before all production from the formation ceases due to economics or oil depletion.

The appropriate length of a period of injection or production will depend upon the conditions of the reservoir and the viscosity of the oil therein. Economics may also be a factor. A period or stage should be sufficiently long that the reservoir fluids—oil, gas, brine, steam and water—will have an opportunity to equilibrate. However, a period will preferably not be long enough to allow flow patterns and channelization to occur to a large degree. If flow patterns do form, a switch should be made to the next period of injection or production to disrupt the flow pattern. During some periods, pressure will build in the reservoir. The length of a period should not be long enough to allow pressure to build enough to fracture the underground formation or to cause additional channelization. The length of each period to meet these conditions may be estimated by computer simulation of the reservoir and the performance of various oscillation schemes in the simulated reservoir, using the characteristics of the reservoir and actual steamflood results as data for the computer simulation program.

The periods of injection and production will preferably be similar in length. However, some adjustment in the length of the periods will probably be needed after some initial injection into and production from the reservoir when more information about the reservoir fluids and characteristics will become available. Similarly, additional adjustment in period length will probably be needed at later stages as reservoir conditions and fluids change with the approaching depletion of the reservoir. Under most circumstances, the length of the periods for injection and production before change should be about one month to about 12 months.

COMPUTER SIMULATIONS

Each simulation was conducted with THERM ®, a three-dimensional reservoir simulator available from Scientific Software-Intercomp for simulating thermal recovery operations. This simulator simultaneously solves a set of mass and energy balance equations for each of a number of grid blocks representing a reservoir or a portion of a reservoir. Mass transport equations account for Darcy flow, including gravitational, viscous, and capillary forces. Heat transport equations include convection and conduction within the reservoir, and conductive heat loss to the formations both above and below the reservoir. The simulator allows the use of any number of components. For the simulations of steamfloods according to this invention, the oil was assumed to be non-distillable heavy oil. One hydrocarbon component was used along with the water component.

For each steamflood simulation, the steamflood was assumed to take place in a homogeneous horizontal reservoir, 60 feet thick, with a 2.5 acre 5-spot pattern or larger 7-spot or 9-spot pattern. The reservoir had a porosity of 33%, horizontal permeability of 4800 millidarcies (md) and vertical permeability of 800 md. The oil saturation before steamflooding according to this invention was 55%, with a water saturation of 45%. The API gravity of the oil was 13.0 degrees, with a viscosity of 3550 cps at the reservoir temperature of 95° F. These and other reservoir rock and fluid properties used in each simulation are summarized in Tables 1 and 2 below.

TABLE 1

RESERVOIR ROCK AND FLUID PROPERTIES

1. Reservoir Description

| | |
|---|---|
| Permeability | |
| Horizontal | = 4800 md |
| Vertical | = 800 md |
| Porosity | = 0.33 |
| Rock Heat Capacity | = 35.0 Btu/cu ft-°F. |
| Rock Thermal Conductivity | = 38.4 Btu/ft-day-°F. |
| Overburden Heat Capacity | = 35.0 Btu/cu ft-°F. |
| Overburden Thermal Conductivity | = 38.4 Btu/ft-day-°F. |
| Rock Compressibility | = 0.000735 (psi) |
| Initial Saturations | |
| Water | = 0.45 |
| Oil | = 0.55 |

2. Fluid Data

| Component | MW | Compressibility $(psi)^{-1}$ | Thermal Expansion $(°F.)^{-1}$ | Heat Capacity Btu/lb °F. |
|---|---|---|---|---|
| $H_2O$ | 18 | | | |
| Oil | 420 | $0.5 \times 10^{-5}$ | 0.00039 | 0.50 |

Oil Density = 61.1 lb/ft$^3$

Oil Viscosity-Temperature Relationship

| Temp, °F. | Viscosity, cp |
|---|---|
| 95 | 3550 |
| 500 | 1.26 |

TABLE 2

BASIC ASSUMPTIONS FOR EACH SIMULATION

| | | | |
|---|---|---|---|
| Reservoir | | | |
| Thickness | 60 ft | | |
| Temperature | 95° F. | | |
| Pressure | 40 psia | | |
| Pattern | | | |
| Type | 5-spot | 7-spot | 9-spot |
| Size | 2.5 acres | 5 acres | 7.5 acres |
| Bottom hole pressure (BHP) at Producer | 20 psia | | |
| Completion intervals Injector and producer | Lower one-half | | |
| Steam stimulation | | | |
| Slug size | 11.0 MSTB | | |
| Timing | 0 day and 182.5 day | | |

TABLE 2-continued

BASIC ASSUMPTIONS FOR EACH SIMULATION

| | |
|---|---|
| Cut-off point for steamflood | When the instantaneous steam/oil ratio reaches 10 B/B |
| Criterion for steamflood | Oil recovery, % OIP at start of steamflood |
| Steam | |
| Pressure | 300 psia (418° F.) |
| Quality | 45% for displacement, 70% for stimulation |

TABLE 3

5-SPOT PATTERN BASE CASES WITHOUT STAGGERED SCHEDULING OF ALTERNATE ROWS

| | Ex. No. 1 | Ex. No. 2 | Ex. No. 3 | Ex. No. 4 |
|---|---|---|---|---|
| | Description | | | |
| Time, yr. | No Osc. | Osc. in inj. only | Osc. in prod. only | Osc. in both inj. & prod. in-phase |
| | Oil Recovery, % | | | |
| 0.5 | | 0.87 | 0.00 | 0.87 |
| 1.0 | 2.28 | 4.46 | 1.17 | 0.87 |
| 1.5 | | 10.43 | 1.17 | 10.40 |
| 2.0 | 11.16 | 15.16 | 7.32 | 10.40 |
| 2.5 | | 31.23 | 7.32 | 30.65 |
| 3.0 | 34.91 | 39.92 | 30.65 | 30.65 |
| 3.5 | | 48.02 | 30.65 | 46.79 |
| 4.0 | 46.77 | 50.34 | 45.78 | 46.79 |
| 4.5 | | 53.84 | 45.78 | 53.76 |
| 5.0 | | | 53.67 | |
| Project Life, yr. | 4.75 | 4.50 | 5.00 | 4.50 |
| Final Recovery, % | 51.46 | 53.84 | 53.67 | 53.76 |
| Increase Over Base Case, % (Ex. 1) | 0 (Base Case) | 4.6 | 4.3 | 4.5 |

TABLE 4

STAGGERED SCHEDULING OF INJECTORS FOR 5-SPOT PATTERNS

| | INJECTORS | | PRODUCERS | |
|---|---|---|---|---|
| | Ex. No. 5 (FIG. 1) | Ex. No. 6 (FIG. 2) | Ex. No. 7 (FIG. 3) | Ex. No. 8 (FIG. 4) |
| | Description | | | |
| Time, yr. | Horizontal (H) row alternation | Diagonal (D) row alternation | H-Vertical (V) alternation | H-D1-V-D2 alternation |
| | Oil Recovery, % | | | |
| 1 | 2.73 | 2.74 | 1.58 | 1.58 |
| 2 | 10.90 | 10.79 | 8.95 | 8.97 |
| 3 | 34.81 | 33.85 | 23.05 | 24.09 |
| 4 | 49.10 | 48.92 | 43.27 | 42.25 |
| 5 | | | 51.82 | 51.27 |
| Project Life, yr. | 4.55 | 4.58 | 5.30 | 5.69 |
| Final Recovery, % | 52.57 | 52.55 | 53.57 | 54.83 |
| Increase Over Base Case, % (Ex. 1) | 2.2 | 2.1 | 4.1 | 6.5 |

The steam injection rate for Example 1, the 5-spot base case without oscillation was constant at 300 barrels per day (BPD) cold water equivalent (CWE). To make the quantities of injected steam equal to those of Example 1, the steam injection for 5-spot alternating row examples (Examples 5-6, and shown in FIGS. 1 and 2, and Example 10 shown in FIG. 5,) was raised to 600 BPD CWE since for half the time, half the injection wells would be receiving zero injected steam. The base cases of Examples 2 and 4 also received 600 BPD. Where there was no cycling of injectors in Examples 7–8, (FIGS. 3–4), the injection rate was 300 BPD.

With the staggered scheduling of injection wells alone, the oil recovery curves essentially follow the curve for the base case. When the producers are involved either by themselves or in conjunction with the injectors, the oil recovery curves usually lag behind the curve for the base case. But in all cases, the final oil recovery exceeds that of the base case. The retardation of oil production should be included in economic considerations, along with the increase in final oil recovery.

For all FIGS. 1–10, the area of the computer simulation is shaded gray.

TABLE 5

STAGGERED SCHEDULING OF BOTH INJECTORS AND PRODUCERS FOR 5-SPOT PATTERNS

| | Ex. No. | |
|---|---|---|
| | 9 | 10 (FIG. 5) |
| | Description | |
| | Base case for Ex. 10 No osc. | Vertical row altern. |
| Time, yr. | Oil Recovery, % | |
| 1 | 0.85 | 1.56 |
| 2 | 6.16 | 6.39 |
| 3 | 25.15 | 20.82 |
| 4 | 39.71 | 37.25 |
| 5 | 48.83 | 47.34 |
| 6 | | 53.83 |
| Project Life, yr. | 5.70 | 6.31 |
| Final Recovery, % | 52.84 | 55.65 |
| Increase Over Base Case, % (Ex. 9) | | 5.3 |

A different base case (Example 9) was required for the staggered scheduling of injectors and producers of Example 10. It was necessary to simulate a strip area as shown by gray shading in FIG. 5. (Example 10).

TABLE 6

| | 7-SPOT PATTERNS | | | | |
|---|---|---|---|---|---|
| | | Staggered Scheduling of | | | |
| | | Ex. No. | | | |
| | | Injection | Production | Both Inj. & Prod. | |
| | 11 | 12 (FIG. 6) | 13 (FIG. 7) | 14 (FIG. 8) | 15 (FIG. 9) |
| | | Description | | | |
| | No osc. | 120° row altern. | 120° row altern. | 30° row altern. | 120° row altern. |
| Time, yr. | Oil Recovery, % | | | | |
| 1 | 12.12 | 11.88 | 10.06 | 8.90 | 10.07 |
| 2 | 28.46 | 28.80 | 24.13 | 23.83 | 23.75 |
| 3 | 41.81 | 43.04 | 37.95 | 38.29 | 38.12 |
| 4 | 49.23 | 50.65 | 48.10 | 48.61 | 48.73 |
| Project Life, yr. | 4.16 | 4.09 | 4.72 | 4.73 | 4.72 |
| Final Recovery, % | 50.03 | 51.16 | 52.52 | 53.04 | 53.34 |
| Increase Over Base Case, % (Ex. 11) | | 2.2 | 5.0 | 6.0 | 6.6 |

For the base case of Example 11 where injection and production are on all the time, it was necessary to double the rate of steam injection per well from the 300 BPD of Example 1 to 600 BPD CWE due to a doubling in pattern area. For the staggered injection examples of Examples 12 (FIG. 6), 14 (FIG. 8) and 15 (FIG. 9), the steam injection rate was again doubled to 1200 BPD so that overall injected steam quantities were equal to Example 11.

TABLE 7

| | 9-SPOT PATTERNS | | | | |
|---|---|---|---|---|---|
| | | Staggered Scheduling of Ex. No. | | | |
| | | Injectors | | Producers | |
| | 16 | 17 | 18 | 19 | 20 (FIG. 10) |
| | | Description | | | |
| | No. osc. | Horiz. row altern. | Diag. row altern. | Horiz. row altern. | Diag. row altern. |
| Time, yr. | Oil Recovery, % | | | | |
| 1 | 2.41 | 3.67 | 3.66 | 2.40 | 3.04 |
| 2 | 15.87 | 16.13 | 16.12 | 14.07 | 15.46 |
| 3 | 27.13 | 27.29 | 27.31 | 24.25 | 25.67 |
| 4 | 36.23 | 36.89 | 36.86 | 33.46 | 34.17 |
| 5 | 45.04 | 46.11 | 46.02 | 41.62 | 41.77 |
| 6 | | | | 48.94 | 49.50 |
| Project Life, yr. | 5.93 | 5.94 | 5.92 | 6.55 | 6.77 |
| Final Recovery, % | 50.21 | 51.71 | 51.61 | 52.75 | 54.11 |
| Increase Over Base Case, % (Ex. 16) | | 3.0 | 2.8 | 5.1 | 7.8 |

For the base case of Example 16 where injection and production are on all the time, it was necessary to triple the rate of steam injection per well from the 300 BPD of Example 1 to 900 BPD CWE due to a tripling in pattern area. For the staggered injection examples of Examples 17–18, the steam injection rate was again doubled to 1800 BPD so that overall injected steam quantities were equal to Example 16.

Many other variations and modifications may be made in the concepts described above by those skilled in the art without departing from the concept of the present invention. Accordingly, it should be clearly understood that the concepts disclosed in the description are illustrative only and are not intended as limitations on the scope of the invention.

What is claimed is:

1. A method for recovering hydrocarbons from a hydrocarbon bearing formation penetrated by multiple 5-spot, inverted 5-spot, 7-spot, or 9-spot patterns of injection and production wells, comprising:

injecting steam into a hydrocarbon bearing formation penetrated by multiple 5-spot, inverted 5-spot, 7-spot, or 9-spot vertical well patterns through a first group of wells comprising approximately one-half of the injection wells of the patterns;

ceasing steam injection through the first group of wells and injecting steam into the formation through a second group of wells comprising approximately the remaining one-half of the injection wells excluded from the first group;

ceasing steam injection through the second group of wells and injecting steam into the formation through a third group of wells comprising approximately one-half of the injection wells of the patterns;

ceasing steam injection through the third group of wells and injecting steam into the formation through a fourth group of wells comprising approximately the remaining one-half of the injection wells excluded from the third group, said first group of injection wells comprising alternating rows of wells separated by alternating rows of the second group of injection wells, said third group of injection wells comprising alternating rows of wells separated by alternating rows of the fourth group of injection wells, said alternating rows of injection wells arranged in horizontal rows, vertical rows or diagonal rows where the alternating rows of injection wells in the first and second groups are different from the alternating rows of injection wells in the third and fourth groups; and producing hydrocarbons and other fluids from production wells in the 5-spot, inverted 5-spot, 7-spot, or 9-spot well patterns.

2. The method of claim 1, wherein the first group of wells is the same as the third group and the second group of wells is the same as the fourth group.

3. The method of claim 2, wherein the well patterns are 5-spot or inverted 5-spot and the alternating rows are arranged at an approximate angle of 45° or 135° from the rows of injection wells.

4. The method of claim 2, further comprising repeating the steps of injecting steam and ceasing steam injection into alternating rows of injection wells.

5. The method of claim 2, wherein steam is injected into a group of wells for about one month to about 12 months before steam injection ceases into said group of wells.

6. The method of claim 2, wherein hydrocarbons and other fluids are continuously produced from the formation.

7. The method of claim 2, further comprising producing hydrocarbons and other fluids through production wells of the well patterns by alternating between two different production rates for a first group of production wells and a second group of production wells, said first group of production wells comprising alternating rows of wells separated by alternating rows of the second group of production wells, said alternating rows of production wells arranged in horizontal rows, vertical rows, or diagonal rows.

8. The method of claim 7, wherein one of the two different production rates is a zero production rate.

9. The method of claim 7, wherein one of the two different production rates is applied to the first group of production wells at the same time the second of the two different production rates is applied to the second group of production wells.

10. The method of claim 7, wherein one of the two different production rates is applied simultaneously to the first and second groups of production wells and then the second of the two different production rates is applied simultaneously to the first and second groups of production wells.

11. A method for recovering hydrocarbons from a hydrocarbon bearing formation penetrated by multiple 5-spot, inverted 5-spot, 7-spot, or 9-spot patterns of injection and production wells, comprising:

injecting steam into a hydrocarbon bearing formation penetrated by multiple 5-spot, inverted 5-spot, 7-spot, or 9-spot vertical well pat-terns through injection wells of the patterns;

producing hydrocarbons and other fluids through a first group of production wells comprising approximately one-half of the production wells of the patterns;

ceasing production through the first group of wells and producing hydrocarbons and other fluids through a second group of production wells comprising approximately the remaining one-half of the production wells excluded from the first group;

ceasing production through the second group of wells and producing hydrocarbons and other fluids through a third group of production wells comprising approximately one-half of the production wells of the patterns; and ceasing production through the third group of wells and producing hydrocarbons and other fluids through a fourth group of production wells comprising approximately the remaining one-half of the production wells excluded from the third group, said first group of production wells comprising alternating rows of wells separated by alternating rows of the second group of production wells, said third group of production wells comprising alternating rows of wells separated by alternating rows of the fourth group of production wells, said alternating rows of production wells arranged in horizontal rows, vertical rows or diagonal rows.

12. The method of claim 11, wherein the first group of wells is the same as the third group and the second group of wells is the same as the fourth group.

13. The method of claim 12, wherein the well patterns are 5-spot or inverted 5-spot and the alternating rows are arranged at an approximate angle of 45° or 135° from the rows of injection wells.

14. The method of claim 12, further comprising repeating the steps of producing hydrocarbons and ceasing production from alternating rows of production wells.

15. The method of claim 12, wherein hydrocarbons are produced from a group of wells for about one month to about 12 months before production ceases from said group of wells.

* * * * *